US007073573B2

(12) United States Patent
Agee

(10) Patent No.: US 7,073,573 B2
(45) Date of Patent: Jul. 11, 2006

(54) DECREASED HOT SIDE FIN DENSITY HEAT EXCHANGER

(75) Inventor: Keith D. Agee, Torrance, CA (US)

(73) Assignee: Honeywell International, Inc., Morristown, NJ (US)

( * ) Notice: Subject to any disclaimer, the term of this patent is extended or adjusted under 35 U.S.C. 154(b) by 47 days.

(21) Appl. No.: 10/864,553

(22) Filed: Jun. 9, 2004

(65) Prior Publication Data

US 2005/0274501 A1 Dec. 15, 2005

(51) Int. Cl.
*F28F 13/00* (2006.01)

(52) U.S. Cl. ..... 165/146

(58) Field of Classification Search ..... 165/146, 165/147

See application file for complete search history.

(56) References Cited

U.S. PATENT DOCUMENTS 1,524,520 A * 1/1925 Junkers ..... 165/146
3,992,168 A * 11/1976 Toyama et al. ..... 165/166
4,049,051 A * 9/1977 Parker ..... 165/146
5,437,328 A * 8/1995 Simons ..... 165/146
5,709,264 A * 1/1998 Sweeney et al. ..... 165/146
5,915,469 A 6/1999 Abramzon et al.
5,934,363 A * 8/1999 Jung et al. ..... 165/146
6,422,307 B1 7/2002 Bhatti et al.
6,634,419 B1 10/2003 Beldam et al.
2001/0006103 A1 7/2001 Nash et al.
2002/0174980 A1 11/2002 DiBene, II et al.
2003/0159814 A1 8/2003 Sin et al.

FOREIGN PATENT DOCUMENTS

EP 0797065 A2 9/1997
WO WO 97/37187 10/1997
WO PCT ISR/WO 11/2005

* cited by examiner

*Primary Examiner*—Teresa J. Walberg
(74) *Attorney, Agent, or Firm*—Chris James; Vidal Oaxaca

(57) ABSTRACT

Apparatus and method for cooling heated fluids, such as exhaust gases, flowing through a heat exchanger including at least one exhaust gas plenum with fins or other heat transfer structure and at least one coolant plenum, and providing decreased heat exchange in that portion of the exhaust gas plenum contacting the inlet thereof by decreasing the fin or heat transfer structure density in such portion relative to the remainder of the exhaust gas plenum.

18 Claims, 5 Drawing Sheets

DECREASED HOT SIDE FIN DENSITY HEAT EXCHANGER

BACKGROUND OF THE INVENTION

1. Field of the Invention (Technical Field)

The present invention relates generally to heat exchangers for liquid cooling of gases from internal combustion engines, particularly heat exchangers with decreased hot side fin densities to minimize coolant overheating and film boiling.

2. Background Art

It is known in the general art of internal combustion engines to provide some system for exhaust gas recirculation (EGR). EGR involves the return to the engine's intake manifold of some portion of the engine exhaust. Exhaust gases are diverted from the exhaust manifold through a duct or conduit for delivery to the intake manifold, thereby allowing exhaust to be introduced to the combustion cycle, so that oxygen content is reduced, which in turn reduces the high combustion temperature that contributes to excessive $NO_x$ formation.

The EGR method of reducing exhaust emissions has drawbacks. A specific problem is that EGR is most effective when the gases are cooled, which problem can be solved in part by using heat exchangers. It is known to provide heat exchangers in conjunction with EGR systems, whereby the heated exhaust passes through a heat exchanger core, together with a suitable coolant separated from the exhaust by a wall or other means. Such heat exchangers may be "multi-pass," in that either heated exhaust or coolant, or both, pass two or more times through the heat exchanger core. Exhaust gas enters a heat exchanger at very high temperature and exits at much lower temperature.

Commercial diesel vehicles typically have significant cooling loads for heat exchangers employed in engine cooling, EGR systems and other applications. Prior art liquid cooled heat exchangers employing high temperature hot fluid, such as exhaust gas recirculated for emissions control, can result in boiling of the liquid coolant. This phenomenon often results not from the bulk coolant temperature being too high but rather because the heat exchanger surface temperature in at least some regions exceeds the saturation temperature. The difference between the surface temperature and the liquid temperature, if high enough, can cause localized destructive film boiling to occur. The localized film boiling typically occurs in the gas inlet portion of the heat exchanger, where the temperature of the exhaust gas is highest. Coolant overheating and boiling can result in cracks and leaks in the heat exchanger, as well as performance degradation. It can also result in degradation of the coolant itself, causing the coolant to become corrosive to key components of the engine cooling loop such as radiators.

It is therefore desirable to provide a heat exchanger with characteristics that eliminate or minimize coolant overheating or localized film boiling at the gas inlet portion of the heat exchanger. In particular, it is desirable to provide a heat exchanger with decreased heat transfer or exchange proximate the gas inlet portion of the heat exchanger.

Against the foregoing background, the present invention was developed. The scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate two embodiments of the present invention and, together with the description, serve to explain the principles of the invention. The drawings are only for the purpose of illustrating preferred embodiments of the invention and are not to be construed as limiting the invention. In the drawings.

DESCRIPTION OF THE PREFERRED EMBODIMENTS

Best Modes for Carrying Out the Inventions

The present invention relates to an improved heat exchanger and method for cooling heated fluids while limiting or inhibiting boiling of the coolant fluid. While a primary use of the present invention is for cooling exhaust gases, such as from an internal combustion engine, it is to be understood that the invention can be applied to any heated fluid to be cooled, whether such fluid is a hot gas or a hot liquid, and all such heated fluids are included within the understanding of exhaust gases discussed herein. The invention may thus be applied for cooling the exhaust gases flowing through an exhaust gas recirculation (EGR) system. The invention will find ready and valuable application in any context where heated exhaust is to be cooled, but is particularly useful in EGR systems installed on internal combustion engines, where exhaust is diverted and returned to the input of the power system. The apparatus of the invention may find beneficial use in connection with EGR systems used with diesel-fueled power plants, including but not limited to the engines of large motor vehicles.

The present invention, as further characterized and disclosed hereafter, ameliorates or eliminates certain problems associated with current methods for cooling recirculated exhaust in known EGR systems. Many EGR systems employ heat exchangers to cool exhaust gases before recirculating them to the engine's input manifold. The heat exchangers incorporated into EGR systems function according to generally conventional principles of heat transfer. The hot exhaust gases are directed through an array of tubes or conduits fashioned from materials having relatively high thermal conductivity. These tubes or conduits typically have, running along the length thereof, fins which are employed to assist in heat transfer. These hot gas conduits, including the fins, are placed in intimate adjacency with coolant conduits. For example, the exterior surfaces of the hot gas conduits may be in direct contact with the exteriors of the coolant conduits, or the hot gas conduits may be enveloped or surrounded by the coolant conduits so as to immerse the hot gas conduits in the flowing coolant itself, or heat transfer fins may extend from the hot gas conduits to or into the coolant conduits, or the like. Heat energy is absorbed from the exhaust by the gas conduits, and then transferred by conduction to the coolant conduits, where the excess heat energy is transferred away by convection. Very preferably, and in most applications necessarily, the hot gas never comes in direct contact with the flowing coolant, the two at all times being separated by at least the walls of the hot gas conduits. The foregoing functions of heat exchangers are well-known, and need no further elaboration to one skilled in the art.

Figure 1:
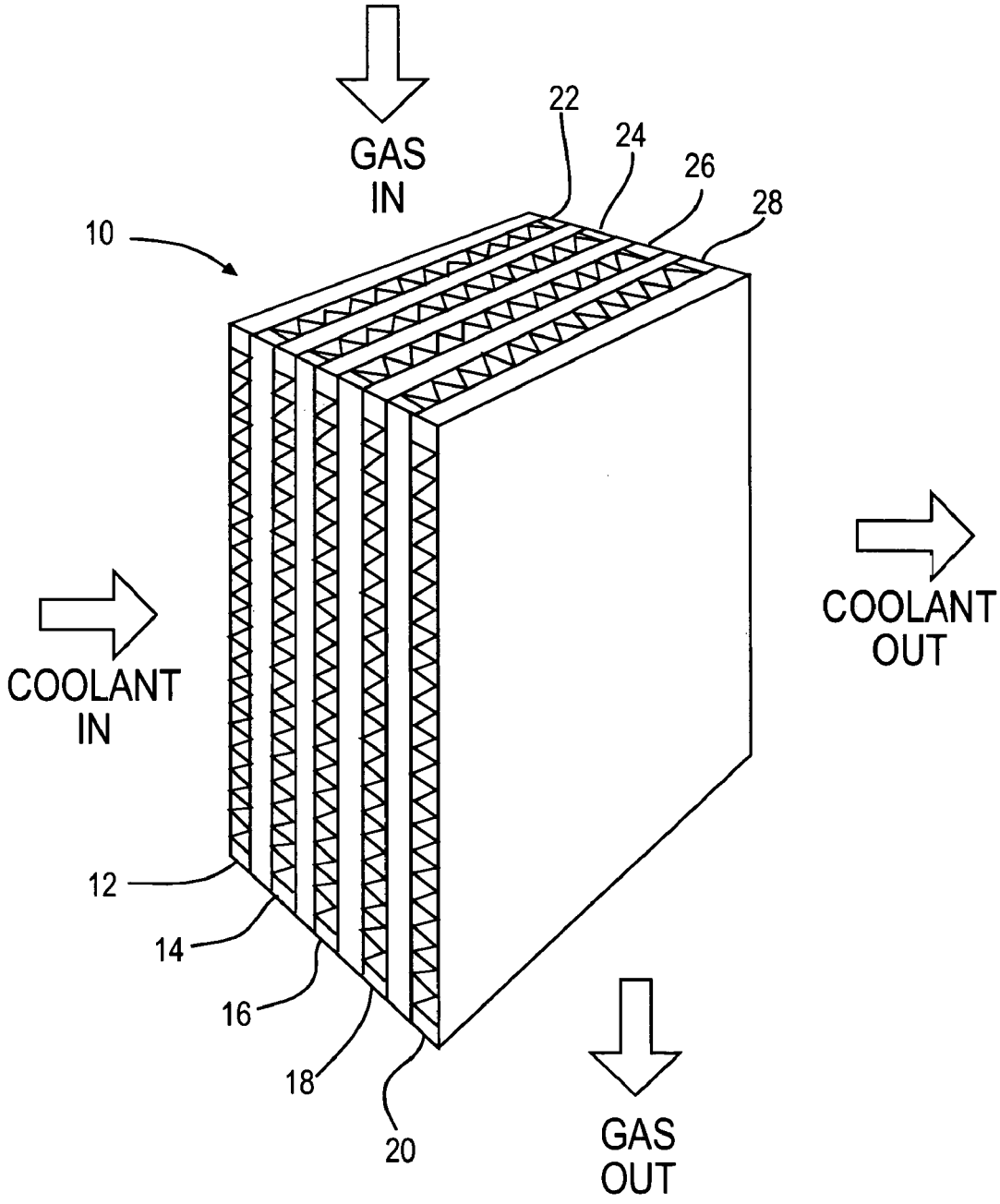
Fig. 1 Prior Art
FIG. 1 is a perspective, diagrammatic, bi-section view of an exhaust gas recirculation cooler from the prior art, showing a "single pass" exhaust gas and coolant configuration.

The present invention is placed in proper context by referring to FIG. 1, showing a heat exchanger or cooler known in the art. For clarity of illustration, FIG. 1 shows a prior art cooler in both vertical and horizontal section, to reveal the interior components of the device. Further, all intake and outlet manifolds are omitted from the drawing for the sake of clarity. The construction, configuration and operation of the cooler of FIG. 1 is within the knowledge of one skilled in the art, including the provision of appropriate manifolds. Referring to FIG. 1, it is seen that a typical core 10 is assembled from a collection of contiguous, parallel, walled plenums. Coolant plenums 12, 14, 16, 18, 20 are sandwiched between exhaust plenums 22, 24, 26, 28 in an alternating manner. Walled coolant plenums 12, 14, 16, 18, 20 contain and convey the flowing coolant (e.g. water, an aqueous mixture of ethylene glycol or the like). Exhaust plenums 22, 24, 26, 28 further include extended surfaces or fins, depicted as a single zigzag pleated or corrugated sheet disposed between the confronting walls, extending along and defining the axial flow passages of exhaust plenums 22, 24, 26, 28.

In FIG. 1, the coolant is directed to flow from the left of core 10 to the right, via the coolant passages in coolant plenums 12, 14, 16, 18, 20 as suggested by the large directional arrows for coolant flow of the figure. In FIG. 1, coolant plenums 12, 20 are the outermost plenums of the core 10, with exhaust plenums 22, 24, 26, 28 being interior thereto. It is to be seen that in this configuration there is always one more coolant plenum than the number of exhaust plenums. While this configuration presents certain advantages, other configurations are possible and contemplated, including exterior most exhaust plenums.

Prior art core 10 shown in FIG. 1 is of a "single pass" exhaust variety, that is, the hot exhaust is passed between the coolant plenums 12, 14, 16, 18, 20 a single time before being returned to the engine intake manifold. "Double pass" cores are known, involving two passes of the exhaust gas through the core. "Multiple pass" cores, involving three or more passes of the exhaust gas through the core are known, but seldom encountered. In, for example, double pass exhaust cores, the hot exhaust flows in opposing directions during separate passes through the core 10. Hot gas flows from top to bottom (as viewed in FIG. 1) during the first pass through the core 10, and subsequently from bottom to top during the second pass. There is provided some conventional means, such as ordinary U-fittings joining the ends of corresponding passages, for reversing the hot gas direction of flow between passes through core 10. One or more sealing exhaust dividers is provided between opposing pairs of exhaust plenum walls to separate the first pass exhaust flow from the second-pass flow, typically without interfering with the coolant flow through coolant plenums 12, 14, 16, 18, 20. With reference to FIG. 1, an exhaust divider can be oriented vertically in core 10, such that the hot gas flow would first be top-to-bottom, then reversed on the second pass, or visa-versa. In variations of such configurations it is possible that, for example, some exhaust plenums are used for flow in one direction, and others in another direction. For example, a vertical divider may be provided, oriented parallel to the coolant flow, such as along a cold passage bar, optionally with separator plates on either side of the cold passage bar that keeps the two hot flow directions separate, such that exhaust flow direction is coincident with the full depth of coolant flow. Alternatively, a vertical divider may be provided that is perpendicular to the coolant flow, such that the one exhaust flow direction is coincident with a portion of the depth of coolant flow, and the other exhaust flow direction is coincident with the remainder of the depth of coolant flow.

As indicated by the large directional arrows in FIG. 1, the hot exhaust flows through core 10 in directions perpendicular to the direction of coolant flow, i.e., the hot gas passages axes are disposed at ninety-degree angles relative to the coolant passages, with the hot gases and coolant each flowing in parallel plenums. Other known configurations provide for coolant flow and hot gas flow in parallel, rather than perpendicular, directions; the concepts of the present invention can readily be extended and applied in these alternative configurations.

Figure 2:
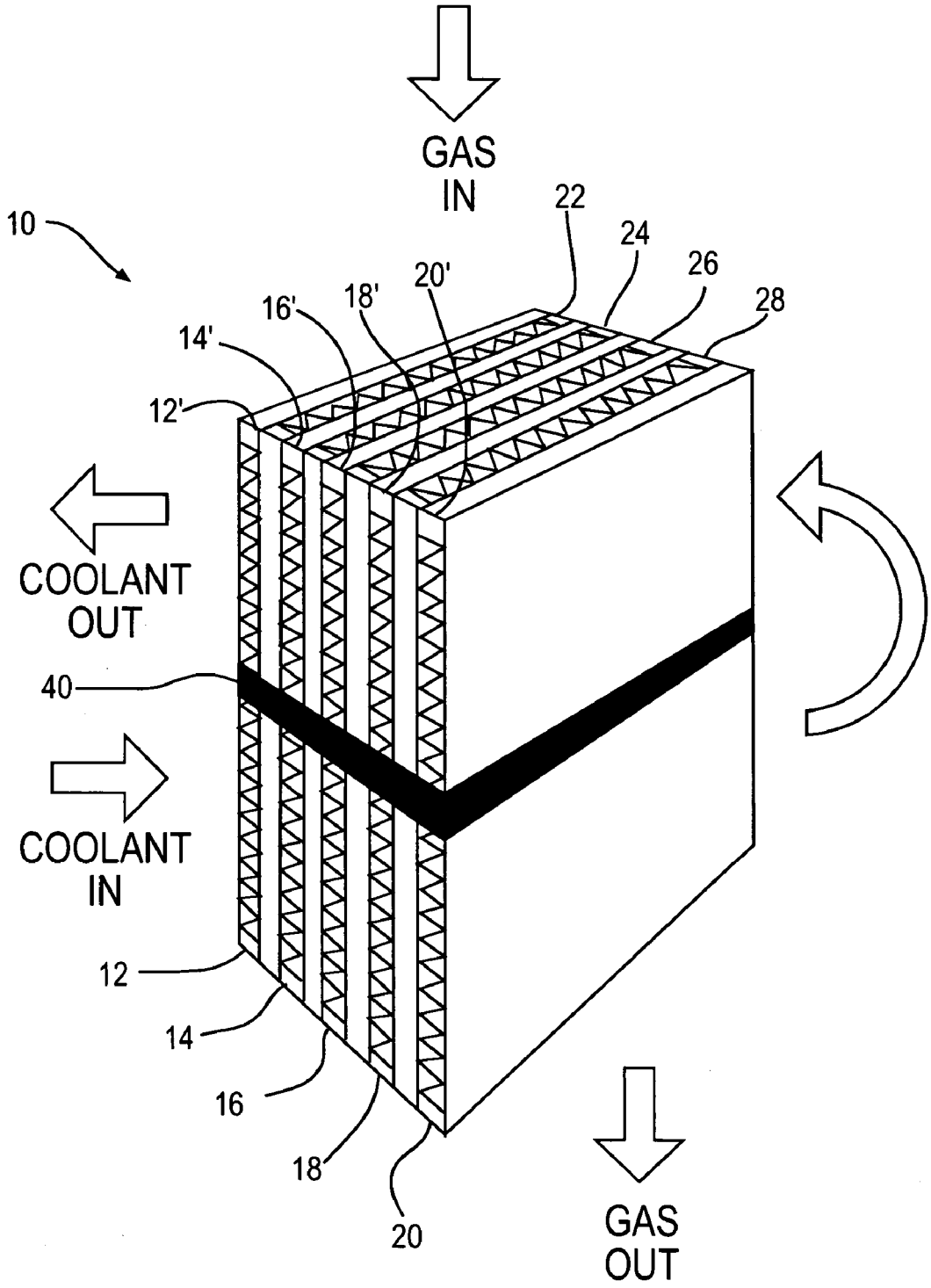
Fig. 2 Prior Art
FIG. 2 is a perspective, diagrammatic, bi-section view of an exhaust gas recirculation cooler from the prior art, showing a single pass exhaust gas configuration with a typical "two pass" coolant configuration of equal passage or equal area configuration.

FIG. 2 depicts a variant heat exchanger known in the art. The core of FIG. 2 is of a "two pass" coolant variety, that is, the coolant is passed between hot exhaust plenums 22, 24, 26, 28 twice. As indicated by the directional arrows in the figure, the coolant flows through core 10 in directions perpendicular to the direction of the exhaust flow, i.e., the coolant passages are disposed at ninety-degree angles relative to the exhaust passages. Other configurations are known and contemplated, including configurations wherein the coolant and hot gas flow in parallel, rather than perpendicular, directions. As shown by the directional arrows in FIG. 2, the coolant flows in opposing directions during separate passes through core 10. Coolant flows from the left to right (as viewed in FIG. 2) during the first pass through core 10, and subsequently from right to left during the second pass. There is, in the prior art heat exchanger of FIG. 2, provided some conventional means for reversing the coolant flow between passes through core 10, such as ordinary U-fittings joining the ends of corresponding passages. Sealing divider 40 is provided between opposing pairs of coolant plenum walls to separate the first pass coolant flow from the second-pass coolant flow, without interfering with the exhaust flow through hot exhaust plenums 22, 24, 26, 28. As shown in FIG. 2, divider 40 typically extends the entire dimension of the core. It may be seen and appreciated that in the heat exchanger of FIG. 2 the area-in-flow of first pass coolant plenums 12, 14, 16, 18, 20 is the same as the area-in-flow of second pass coolant plenums 12', 14', 16', 18', 20'.

The coolant is typically a liquid, and thus absent boiling is relatively incompressible. Because the area-in-flow remains constant for all coolant passes through the core, its velocity will remain essentially unchanged, assuming negligible flow friction losses in the system.

Gas enters a heat exchanger at very high temperature and exits at a much cooler temperature, as a desired result of the heat exchange. In prior art heat exchangers, it is known and appreciated that "burn out" or heat damage to the coolant passage or plenum, as well as localized film boiling of coolant, is most likely to occur at the area where exhaust gas temperatures are highest, i.e., the area of entry into the heat exchanger.

Fins are typically employed within the exhaust passage or plenum in order to provide increased heat transfer to the coolant. Fins may be of any of a wide variety of types, and many variations of fins are possible. Thus fins may be rectangular, or approximately rectangular, such as a pleated sheet, with fins at approximate right angles to the plenum walls, or may be a single zigzag pleated or corrugated sheet, with fins at an acute angle to the plenum wall. Other embodiments are also possible, such fins containing perforations or serrations, or fins which are in a more complex pattern, such as a herringbone pattern made by displacing the fin sidewalls at regular intervals to produce, when viewed from above, a zigzag effect.

Fins may be made from any material known in the art. Typically the fins are made of a material such as stainless steel, but the fins may be made of any material providing heat transfer and capable of withstanding the range of operating temperatures. Thus other metals may be employed, such as nickel or titanium, as well as alloys of metals. Typically the fins are made from very thin material, on the order of about 0.004" thickness.

The present invention addresses and ameliorates the aforementioned problem by decreasing the rate of heat exchange at the area where exhaust gas temperatures are highest, i.e., the area of entry into the heat exchanger. This is done by decreasing the density of fins, such as the fins per unit width of the exhaust plenum, at the area of entry into the heat exchanger relative to the density of fins in the remainder of the exhaust plenum. Because the heat transfer rate from the exhaust gas to the coolant is correlated to the fin density, such as density of fins per unit width, locally decreasing the fin density in the heat exchanger in the vicinity of exhaust gas inlet results in decreased local heat exchange to the coolant, thereby decreasing excessive heat and local film boiling. This reduces coolant boiling, and attendant burnout, leaks and thermal cycle fatigue.

Figure 3:
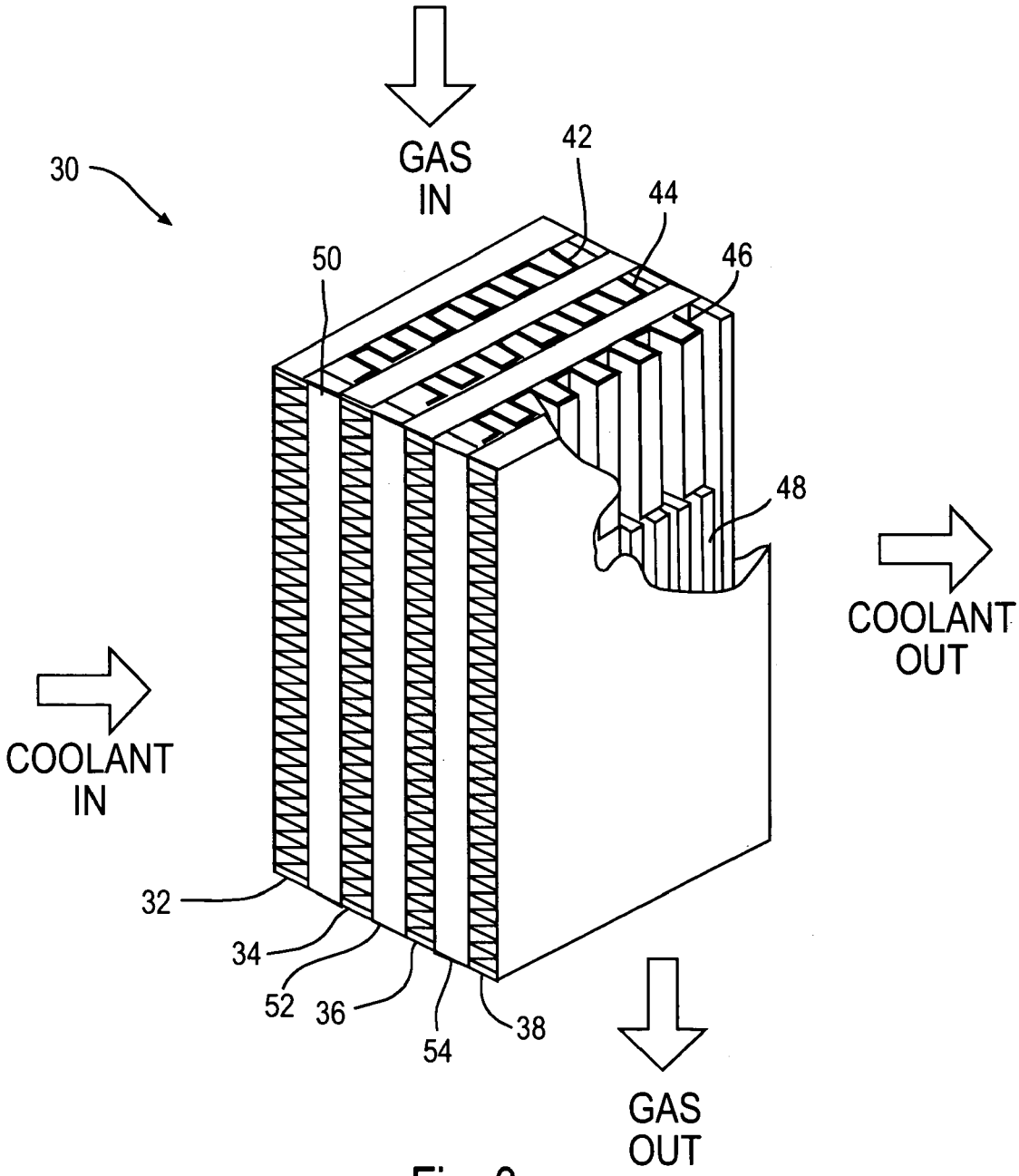
FIG. 3 is a perspective, diagrammatic, bi-section view of an exhaust gas recirculation cooler according to the present invention, showing a decreased array of fins per inch on the exhaust gas pass adjacent the inlet and an increased array of fins per inch on the remaining of the exhaust gas pass.

FIG. 3 depicts the fundamentals of one embodiment of the apparatus of the invention. As in FIG. 1, core 30 is assembled from a collection of contiguous, parallel, walled plenums. Coolant plenums 32, 34, 36, 38 are sandwiched between exhaust plenums 42, 44, 46 in an alternating manner. Walled coolant plenums 32, 34, 36, 38 contain and convey the flowing coolant (e.g. water, an aqueous mixture of ethylene glycol or the like). Exhaust plenums 42, 44, 46 further include extended surfaces or fins, as shown in the cutaway portion of exhaust plenum 46. On the "Gas In" side, as shown by the directional arrow, the single zigzag pleated or corrugated sheet disposed between the confronting walls of exhaust plenum 46 contains a determined number of fins per inch of plenum width, such as for example 10 fins per inch. Downstream from the gas inlet the number of fins per inch increases, as shown in exhaust plenum portion 48, wherein the determined number of fins per inch of plenum width increases, such as for example 16 fins per inch. It is to be understood that while only a cutaway portion of exhaust plenum 46 is shown, there is the same transition from a lower to higher density of fins per inch in each exhaust plenum, including along the axial flow passages of exhaust plenums 42, 44.

FIG. 3 further depicts bars 50, 52, 54 which form the exterior boundaries of the exhaust plenums 42, 44, 46, it being understood that similar bars form a boundary on the opposing side. However, the exhaust plenums 42, 44, 46 could alternatively comprise a flat tube core, such as fins enclosed with flattened oval tubes, or any other design that provides an enclosed hot air passage with interior fins, or other extended surfaces such as partial fins or grooves, serving to increase heat transfer. While in FIG. 3 coolant plenums 32, 34, 36, 38 are depicted with coolant fins, it is not necessary for the invention that coolant plenums include coolant fins, and thus other configurations of coolant plenums may be included in this invention.

By means of the embodiment of the invention shown in FIG. 3, because of the decreased density of fins (such as measured by fins per inch of plenum width) at the point of the inlet for exhaust gas ("Gas In"), heat transfer is decreased in that portion of each exhaust plenum compared to the remainder of the exhaust plenum, wherein the density of fins is increased. Because heat transfer is decreased at the point of the inlet for exhaust gas, which is the point at which the exhaust gas temperature is highest, localized destructive film boiling is reduced or eliminated, thereby eliminating coolant overheating and resulting consequences, including cracks and leaks in the heat exchanger and performance degradation.

While FIG. 3 depicts a single pass coolant and exhaust gas heat exchanger, with perpendicular flows, it may readily be seen that the invention, including decreasing fin density proximate the exhaust gas inlet, with increased fin density in the remainder of the exhaust gas plenums, may be used with any type of heat exchanger, including without limitation heat exchangers providing multiple pass coolant plenums or multiple pass exhaust plenums, or both, or providing coolant plenums parallel to exhaust plenums, or other modifications known in the art or hereafter developed. Similarly, other configurations of coolant and exhaust gas plenums may be employed, such as designs with exterior most exhaust plenums.

Figure 4:
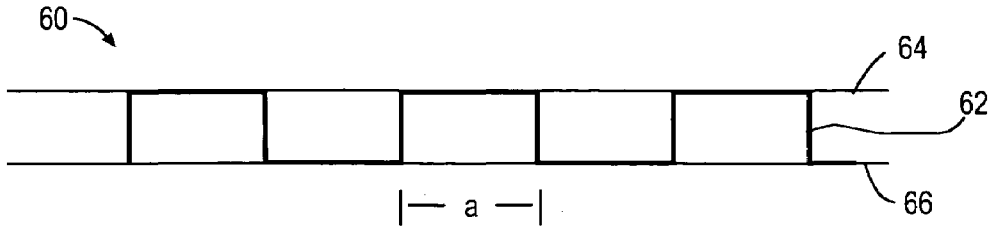
FIG. 4 is a cross-section diagram of an exhaust gas passage adjacent the gas inlet showing a decreased array of right angle fins per inch.
Figure 5:
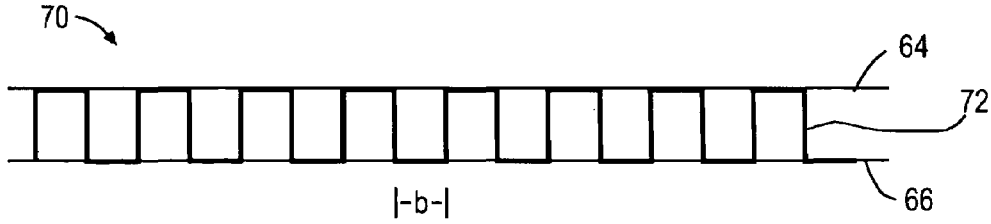
FIG. 5 is a cross-section diagram of an exhaust gas passage downstream from the gas inlet showing an increased array of right angle fins per inch.

FIG. 4 depicts a cross-section diagram, or top view, of an exhaust gas plenum or passage portion 60 adjacent the gas inlet, bounded by plates 64, 66 separating the exhaust plenum from adjacent coolant plenums, wherein fins 62 are a decreased array of right angle fins per inch, as measured by distance a. FIG. 5 is a cross-section diagram, or top view, of the same exhaust gas plenum or passage as in FIG. 4, but here portion 70, downstream from the gas inlet and portion 60, wherein fins 72 are an increased array of right angle fins per inch, as measured by distance b. Thus it may be seen that distance a is greater than distance b, such that the density of fins, such as measured by fins per inch by aggregating distances to an inch, in portion 60 is less than the density of fins in portion 70. As hereafter discussed, the difference in density is such as to accomplish the desired objective of the invention, decreasing undesired local heating of coolant and plates separating coolant and exhaust plenums adjacent the exhaust gas inlet, while still maintaining desired exhaust gas cooling. This may readily be determined empirically or by simulations, based on known heat transfer rates, structures and the like. For example, the distance b may be any percentage, such as from about 50% to 80%, of the distance a.

Figure 8:
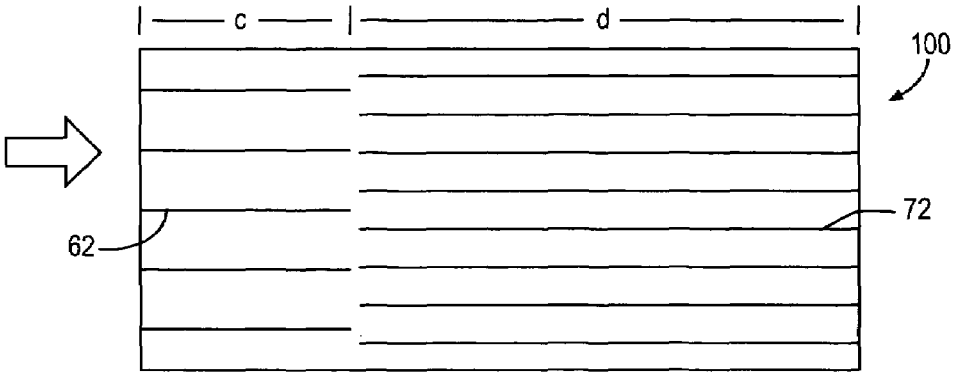
FIG. 8 is a schematic diagram of a top view of an exhaust gas passage according to the present invention, with a first zone of decreased fins per inch adjacent the inlet and a second downstream zone of increased fins per inch.

FIG. 8 depicts a top view schematic diagram of an exhaust gas passage 100 incorporating fins 62 of FIG. 4 and fins 72 of FIG. 5. Given that the fins are generally very thin, such as about 0.004" thickness, no transition or structure is required at the interface between fins 62 and fins 72. The arrow in FIG. 8 depicts the gas inlet, with the plenum length of decreased density fins 62 shown by distance c, and the plenum length of increased density fins 72 shown by distance d. Here too the length of each of c and d, and the relative length or ratio of one to the other, is such as to accomplish the desired objective of the invention, decreasing undesired local heating of coolant and plates separating coolant and exhaust plenums adjacent the exhaust gas inlet, while still maintaining desired exhaust gas cooling. This may readily be determined empirically or by simulations, based on known heat transfer rates, structures and the like. For example, the distance c may be any percentage, such as from about 10% to 50%, of the distance d.

Figure 6:
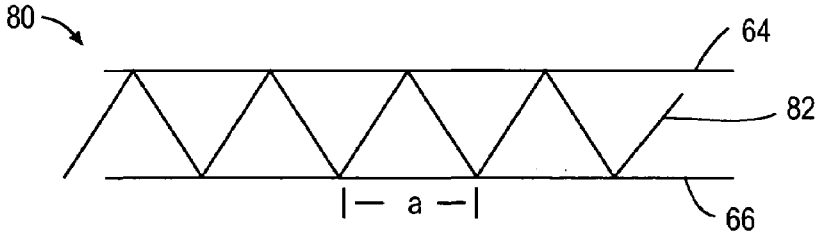
FIG. 6 is a cross-section diagram of an exhaust gas passage adjacent the gas inlet showing a decreased array of zigzag pleated fins per inch.
Figure 7:
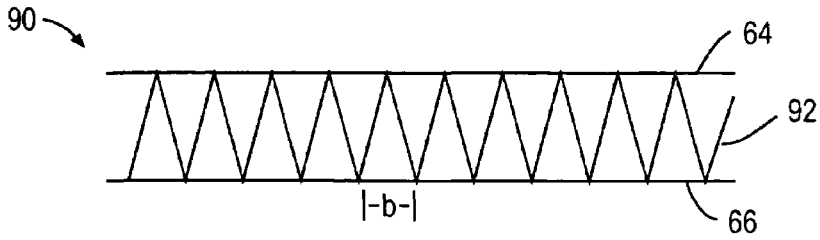
FIG. 7 is a cross-section diagram of an exhaust gas passage downstream from the gas inlet showing an increased array of zigzag pleated fins per inch.

FIG. 6 depicts a cross-section diagram, or top view, of an exhaust gas plenum or passage portion 80 adjacent the gas inlet, bounded by plates 64, 66 separating the exhaust plenum from adjacent coolant plenums, wherein fins 82 are a decreased array of zigzag pleated fins per inch, as measured by distance a. FIG. 7 is a cross-section diagram, or top view, of the same exhaust gas plenum or passage as in FIG. 6, but here portion 90, downstream from the gas inlet and portion 80, wherein fins 92 are an increased array of zigzag pleated fins per inch, as measured by distance b. Thus it may be seen that distance a is greater than distance b, such that the density of fins, such as measured by fins per inch by aggregating distances to an inch, in portion 60 is less than the density of fins in portion 70. As in FIGS. 4 and 5, the difference in density is such as to accomplish the desired objective of the invention. It may further be seen that the structure of FIG. 8 is similarly applicable to the fins of FIGS. 6 and 7.

Figure 9:
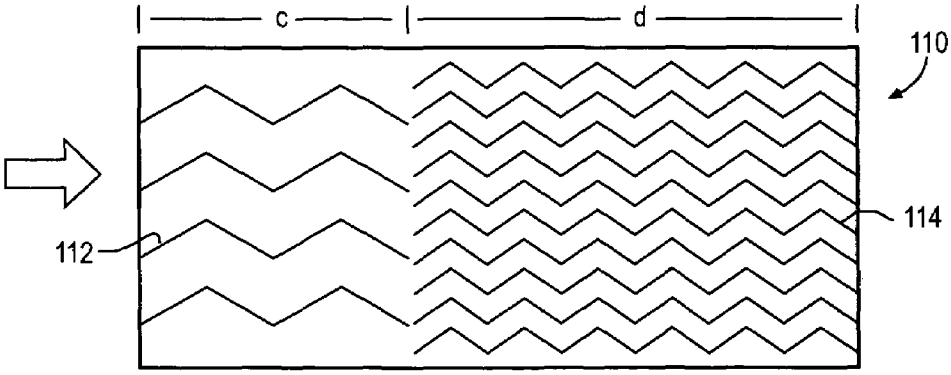
FIG. 9 is a schematic diagram view of an exhaust gas passage according to the present invention, with a first zone of decreased herringbone pattern fins per inch adjacent the inlet and a second downstream zone of increased herringbone pattern fins per inch.

FIG. 9 is a schematic diagram of an exhaust gas plenum or passage 110 according to the present invention, with a first zone 112 of decreased herringbone pattern fins per inch adjacent the inlet and a second downstream zone 114 of increased herringbone pattern fins per inch downstream therefrom. In this embodiment, the herringbone pattern causes the axial flow of exhaust gases through passage 110 to follow the structure created by such herringbone pattern, it being understood that the cross-section of the fins may be triangular, such as zigzag pleated fins as in FIGS. 6 and 7, right angle fins as in FIGS. 4 and 5, or in general any other shape or configuration. Here too the arrow in FIG. 9 depicts the gas inlet, with the plenum length of decreased density fins 112 shown by distance c, and the plenum length of increased density fins 114 shown by distance d. Here too the length of each of c and d, and the relative length or ratio of one to the other, is such as to accomplish the desired objective of the invention. For example, the distance c may be any percentage, such as from about 10% to 50%, of the distance d.

It is also possible and contemplated that the method and apparatus set forth here may be combined with methods and apparatus addressing a similar problem. In particular, the invention disclosed herein may be combined with methods and devices for varying the velocity of flow of coolant, such as multiple pass coolant plenums of variable area-in-flow, such that the area-in-flow of first pass coolant plenums is less than the area-in-flow of second pass coolant plenums, and accordingly the velocity of coolant in first pass coolant plenums is higher than the velocity of coolant in second pass coolant plenums, or alternatively a design providing tank shaping and baffling at the outlet of the cooling plenum, which shaping and baffling results in increased velocity, with concomitant decreased boundary layers, for that portion of the coolant plenum(s) adjacent to the gas exhaust inlet side of the first pass exhaust plenum. Such methods and devices are taught in commonly owned patent application Ser. No. 10/256,063, incorporated herein by reference as if set forth in full.

In computer modeling experiments, the heat transfer and surface temperatures were compared by calculations based on two heat exchanger models. Both models assumed a twelve inch hot gas heat exchanger core length, as for example in FIG. 8, with a hot gas inlet temperature of 1112° F., a fluid coolant inlet temperature of 208° F., and a maximum target surface temperature, for any portion of the fluid coolant walls, of 275° F. In the model of a prior art heat exchanger, the heat exchanger had a uniform 16 fins per inch over the twelve inch core length. In the model of a heat exchanger of this invention, the heat exchanger had two sections, a first section 62 with 10 fins per inch (i.e., where a is 0.1") for the initial, hot side, three inches, or length c, of the heat exchanger core length, and a second section 72 with 16 fins per inch (i.e., where b is 0.0625") over the remaining nine inches, or length d, of the heat exchanger core length. In the model of a prior art heat exchanger, using the parameters given, the calculated hot gas temperature out was 314° F., with a maximum surface temperature of 289° F., and heat transference at a rate of 43.3 BTU/minute. In the model of a heat exchanger of this invention, in the first section the calculated hot gas temperature out (i.e., the temperature at the transition between the first section with 10 fins per inch and the second section with 16 fins per inch) was 851° F., with 14.7 BTU/minute heat transference, but the maximum surface temperature was only 275° F. In the second section, the calculated hot gas temperature out was 343° F., with a maximum surface temperature of 266° F., and heat transference at a rate of 27.1 BTU/minute. Thus the aggregate heat transference (adding the first and second section) for the model of a heat exchanger of this invention was 41.8 BTU/minute, a reduction in heat transfer of less than 4%, but with a maximum surface temperature of 275° F., less than the maximum surface temperature of 289° F. in the model of a prior art heat exchanger. It is noted that this reduction in temperature, to 275° F., is with most coolants sufficient to prevent coolant overheating or localized film boiling. It is further obvious to one of skill in the art that the simple expedient of increasing the core length will permit the total heat transfer to be increased, such that the hot gas temperature out or total heat transfer is at least equal to that of a heat exchanger with a constant fin density core. Alternately, the fin density may be increased in the second section, which, in the model, has an adequate margin with respect to surface temperature to permit a greater fin density.

From the foregoing, it is apparent that the present invention includes innovative methods for preventing excess heat and heat transfer adjacent to the hottest portion of the exhaust gas, that being the exhaust gas as it enters the core. In one embodiment, the method includes providing a heat exchanger with at least one exhaust plenum with fins or similar structures intended to facilitate heat transfer, wherein the density of fins, such as determined by the number of fins per unit width of the exhaust plenum, is less adjacent to the exhaust gas inlet than it is further downstream. Thus the method includes use of an exhaust plenum wherein the density of fins is varied along the path of axial flow of exhaust gas, with the density being less adjacent the exhaust gas inlet than it is further downstream.

It is further apparent that other variations are possible and included within the scope of this invention. For example, it is possible to employ an area without fins in the exhaust plenum adjacent the exhaust gas inlet, with fins introduced downstream within the plenum. In general, this approach is not advantageous because some fins are desirable, in order to obtain the optimal heat transfer, such that as much heat as possible is transferred without exceeding a determined temperature limit for the coolant wall or separation plates. Additionally, a lowered structural resistance to pressure cycle fatigue may also provide a reason for not totally eliminating fins, at least over any but a very small area. Alternatively, it is possible to employ different fin designs to accomplish the same objective, such as straight fins as in first zone 62 of FIG. 8 and herringbone fins as in second zone 114 of FIG. 9. It may readily be seen that variations such as this will accomplish the objectives of the invention.

Thus although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A heat exchanger comprising:

at least one exhaust plenum for containing flowing heated fluid having at least one inlet receiving flowing heated fluid and at least one outlet for discharging flowing heated fluid, said inlet(s) spaced from said outlet(s), and having at least one first zone adjacent to the at least one inlet of the exhaust plenum, the first zone comprising a heat transfer structure, and at least one second zone downstream from the first zone, with the second zone comprising a higher heat transfer structure than the first zone; and at least one coolant plenum for containing flowing coolant, the coolant plenum contacting at least one exhaust plenum;

wherein the coolant flows generally perpendicular or generally parallel to the heated fluid.

2. The apparatus according to claim 1, wherein the first zone and second zone comprise a multiplicity of heat transfer fins generally axial with the flow of exhaust, wherein the number of fins in the first zone is less than the number of fins in the second zone.

3. The apparatus according to claim 2, wherein the heat transfer fins comprise right angle fins or zigzag pleated fins.

4. The apparatus according to claim 1, wherein the second zone comprises fins generally axial with the flow of exhaust and displaced a determined distance sideways at regular intervals with respect to the axial flow of exhaust.

5. The apparatus according to claim 1, comprising a plurality of exhaust plenums and a plurality of coolant plenums, wherein the exhaust plenums are arranged in an alternating manner between cooling plenums, every second plenum being a cooling plenum.

6. The apparatus according to claim 1, wherein at least one exhaust plenum has a defined length, with the direction of flow along said length, and a defined width.

7. The apparatus according to claim 6, wherein the first zone and second zone comprise a multiplicity of heat transfer fins generally along the direction of flow, wherein the number of fins per unit of defined width in the first zone is less than the number of fins per unit of defined width in the second zone.

8. The apparatus according to claim 1, wherein the rate of heat transfer in the first zone is less than the rate of heat transfer in the second zone.

9. The apparatus according to claim 1, wherein me heat transfer structure of the first zone and of the second zone is an integral part of the at least one exhaust gas plenum.

10. The apparatus accordingly to claim 8, wherein the at least one exhaust gas plenum comprises a structure with pleats or grooves providing a heat transfer structure.

11. The apparatus according to claim 1, wherein the at least one exhaust gas plenum comprises passage plates defining at least two opposing sides of the at least one exhaust gas plenum, and the heat transfer structure of the first zone and the second zone is a structure interposed between such passage plates.

12. The apparatus accordingly to claim 10, wherein the heat transfer structure is a first pleated sheet in the first zone and a second pleated sheet in the second zone.

13. The apparatus according to claim 11, wherein the number of pleats within the first zone is less than the number of pleats within the second zone.

14. The apparatus according to claim 11, wherein the first pleated sheet and second pleated sheet form heat transfer fins and the number of fins in the first zone is less than the number of fins in the second zone.

15. The apparatus according to claim 11, wherein the pleats of the first pleated sheet and the second pleated sheet are formed of right angles.

16. The apparatus according to claim 11, wherein the pleats of the first pleated sheet and the second pleated sheet are formed of acute angles.

17. The apparatus according to claim 11, wherein at least one of the first pleated sheet and the second pleated sheet further comprise perforations.

18. A method for cooling recirculated exhaust without excessive heating of coolant or heat exchanger components adjacent to an inlet of a heat exchanger, the method comprising:

directing heated exhaust through at least one exhaust plenum with an inlet and an outlet, the highest temperature of such exhaust being at the inlet;

conveying coolant through at least one coolant plenum disposed adjacent to the at least one exhaust plenum;

defining a first area within the exhaust plenum adjacent to the exhaust plenum inlet, the first area comprising a heat transfer structure, and a second area within the exhaust plenum not adjacent to the exhaust plenum inlet, the second area comprising a heat transfer structure;

configuring the exhaust plenum such that the rate of heat transfer in the first area is less than the rate of heat transfer in the second area; and permitting heat energy to be removed from the exhaust;

wherein the coolant flows generally perpendicular or generally parallel to the heated exhaust.

* * * * *